US009661725B2

(12) United States Patent
Gefter et al.

(10) Patent No.: US 9,661,725 B2
(45) Date of Patent: May 23, 2017

(54) WIRE ELECTRODE CLEANING IN IONIZING BLOWERS

(71) Applicant: ILLINOIS TOOL WORKS INC., Glenview, IL (US)

(72) Inventors: Peter Gefter, S. San Francisco, CA (US); Aleksey Klochkov, San Francisco, CA (US); Leslie W. Partridge, San Jose, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/282,303

(22) Filed: May 20, 2014

(65) Prior Publication Data

US 2015/0336109 A1 Nov. 26, 2015

(51) Int. Cl.
*B03C 3/74* (2006.01)
*B03C 3/41* (2006.01)
(Continued)

(52) U.S. Cl.
CPC ..... *H05F 3/06* (2013.01); *B03C 3/41* (2013.01); *B03C 3/743* (2013.01); *H01T 23/00* (2013.01); *H01T 19/00* (2013.01)

(58) Field of Classification Search
CPC combination set(s) only.
See application file for complete search history.

(56) References Cited

U.S. PATENT DOCUMENTS 3,873,835 A * 3/1975 Ignatjev ..... H01T 23/00 250/324
4,202,674 A * 5/1980 Rodenberger ..... B03C 3/04 96/63
(Continued)

FOREIGN PATENT DOCUMENTS

EP 1213949 A1 * 6/2002 ..... H01T 23/00
GB 1305382 A * 1/1973 ..... A61N 1/44
WO WO 2013021378 * 2/2013 ..... H01T 23/00

OTHER PUBLICATIONS

PCT Application PCT/US2015/017687, Notification of Transmittal of the International Search Report . . . and associated International Search Report, mailed Jun. 8, 2015; 5 pages total.
(Continued)

*Primary Examiner* — Duane Smith
*Assistant Examiner* — Sonji Turner
(74) *Attorney, Agent, or Firm* — McAndrews, Held & Malloy, Ltd.

(57) ABSTRACT

Methods and apparatus for cleaning contaminant byproducts off of ionizing wire electrodes in ionizing blowers are disclosed. Disclosed apparatus include a housing with a gas-flow channel, an stationary ionizing wire, and a rotatable frame with supports for resiliently supporting the stationary ionizing wire within the channel. The ionizing wire produces charge carriers and has a surface that develops a layer of contaminant byproducts when an ionizing signal is applied thereto. The frame is rotatably mounted such that the supports clean the layer of contaminant byproducts off of the surface of the ionizing wire when the frame is rotated. Disclosed methods include providing an ionizing signal to the ionizing wire to thereby produce charge carriers and rotating the frame relative to the housing to thereby clean contaminant byproducts off of the ionizing wire.

21 Claims, 11 Drawing Sheets

(51) Int. Cl.

| | |
|---|---|
| ***H05F 3/06*** | (2006.01) |
| ***H01T 23/00*** | (2006.01) |
| *H01T 19/00* | (2006.01) |

(56) References Cited

U.S. PATENT DOCUMENTS

| | | | | |
|---|---|---|---|---|
| 4,442,356 | A | 4/1984 | Ludwick et al. | 250/324 |
| 5,508,880 | A * | 4/1996 | Beyer | H05F 3/04 361/213 |
| 5,973,905 | A * | 10/1999 | Shaw | H01T 23/00 361/231 |
| 6,717,792 | B2 * | 4/2004 | Gorczyca | H01T 23/00 361/212 |
| 6,757,150 | B2 * | 6/2004 | Gorczyca | H01T 23/00 361/231 |
| 7,212,393 | B2 | 5/2007 | Gefter et al. | 361/230 |
| 7,408,759 | B2 * | 8/2008 | Gefter | H01T 23/00 361/230 |
| 7,638,104 | B2 * | 12/2009 | Taylor | B03C 3/12 422/121 |
| 7,821,762 | B2 | 10/2010 | Yasuoka et al. | 361/212 |
| 7,822,355 | B2 | 10/2010 | Schlitz | 399/100 |
| 7,880,137 | B2 * | 2/2011 | McGann | G01N 27/622 250/286 |
| 7,969,707 | B2 * | 6/2011 | Riskin | H01T 23/00 361/230 |
| 8,174,814 | B2 | 5/2012 | Yasuoka et al. | 361/230 |
| 8,444,754 | B2 * | 5/2013 | June | B03C 3/366 55/385.6 |
| 8,492,733 | B1 | 7/2013 | Klochkov et al. | 250/423 |
| 8,613,793 | B2 * | 12/2013 | June | B03C 3/366 361/233 |
| 8,724,286 | B2 * | 5/2014 | Uchida | H01T 23/00 361/230 |
| 2002/0071235 | A1 * | 6/2002 | Gorczyca | H01T 23/00 361/231 |
| 2005/0194583 | A1 * | 9/2005 | Taylor | B03C 3/12 257/10 |
| 2007/0235661 | A1 * | 10/2007 | Gefter | H01T 23/00 250/424 |
| 2008/0199208 | A1 | 8/2008 | Schlitz | 399/100 |
| 2009/0166521 | A1 * | 7/2009 | McGann | G01N 27/622 250/281 |
| 2010/0157503 | A1 * | 6/2010 | Saito | H01T 23/00 361/231 |
| 2011/0116204 | A1 * | 5/2011 | Riskin | H01T 23/00 361/230 |

OTHER PUBLICATIONS

PCT Application PCT/US2015/017687, Written Opinion of the International Searching Authority, mailed Jun. 8, 2015; 5 pages total.

Simco-Ion Datasheet DS-5710_V2 for uWire Aerobar Model 5710, two pages, author unknown, dated Jul. 2012.

Simco-Ion Datasheet, DS-5822i_V8 for Ionizing Blower Model 5822i, two pages, author unknown, dated Mar. 2014.

Simco-Ion Datasheet, DS-6202e_V6 for Ionizing Blower Model 6202e, two pages, author unknown, dated May 2011.

Simco-Ion Datasheet, DS-6422e_V9 for Ionizing Blower Model 6422e, two pages, author unknown, dated Jan. 2013.

Simco-Ion Datasheet, DS-6432_V10 for Ionizing Blower Model 6432, two pages, author unknown, dated Jan. 2013.

Simco-Ion Datasheet, DS-minION_V1-1 for Compact Ionizing Blower Model minION2 , two pages, author unknown, dated May 2012.

* cited by examiner

WIRE ELECTRODE CLEANING IN IONIZING BLOWERS

BACKGROUND OF THE INVENTION

1. Field of the Invention

The present invention is directed to improvements in cleaning ionizing blowers of the type having a wire ionizing electrode supported within a gas stream for ionization of the stream. Accordingly, the general objects of the invention are to provide novel systems, methods, and apparatus of such character.

2. Description of the Related Art

Static-charge neutralizers commonly operate on high ionizing voltages applied to sharp-tipped electrodes or wire/filament electrodes. Ideally, operation of such a neutralizer should produce a moving air stream of electrically balanced quantities of positive and negative ions that can be directed toward a proximate object having an undesirable static electrical charge to be neutralized.

Corona discharge ionizers of the type noted above include ionizing blowers. Some examples of these include the following products that are or have been offered by Simco-Ion of 1750 North Loop Road, Alameda, Calif. 94502: minION2 Compact Ionizing Blower; Benchtop Blower Model 6432e; Ionizing Blower Model 6422e; Ionizing TargetBlower Model 6202e; Ionizing Blower Model 5822i; and μWire AeroBar® Ionizer Model 5710. At least some of these products are the subject of (1) U.S. Pat. No. 7,212,393, entitled "Air Ionization Module And Method", and issued on May 1, 2007; and (2) U.S. Pat. No. 7,408,759, entitled "Self-Cleaning Ionization System", and issued on Aug. 5, 2008. These U.S. patents are hereby incorporated by reference in their entirety.

Ion generation efficiency of corona ionizers of the type discussed above is known to degrade over time due to the deleterious effects associated with the use of high voltage and high current densities present at electrode tips and wires. For example, corrosion, oxidization films, and/or particulate contamination accumulating on the electrode surface(s) are a direct consequence of high voltage corona discharge. Ion production is inversely related to the accumulation of such contaminant byproducts for a number of reasons including the fact that these byproducts insulate the electrode(s) formed of common materials. As ion production decreases, target object discharge times increase until the degraded electrodes cannot even be used as a practical matter. Also, contaminated electrodes are prone to produce ozone and nitrogen oxides which are unacceptable in some applications. Since there are presently no systems in which the electrode alone can be replaced, replacing degraded electrodes necessarily includes replacing other blower components that still operate effectively. This is unnecessarily wasteful and expensive. While the use of titanium or silicon electrodes may reduce electrode erosion/degradation as discussed above, the specialized electrodes are expensive, cannot be used in all applications, and even they degrade over time. Thus, replacement of eroded electrodes (sometimes in complex installations) remains a frequent and expensive maintenance requirement that cannot be avoided, only managed.

One effort to reduce the maintenance discussed above involves periodically cleaning the ionizing electrodes in ionizing blowers. A limitation of this approach is that normal ionization operation must be interrupted while emitter cleaning can take place. As a result, emitter cleaning is performed only periodically and relatively infrequently. Naturally, this means that the ionizing electrodes almost never operate at peak efficiency. Moreover, contaminant accumulations and/or oxidization films can and do develop to the point that they are difficult or impossible to clean with known frictional/physical methods/systems.

Accordingly, improvements in ionizing electrode longevity, cleanliness, maintenance and/or replacement continue to be desirable.

SUMMARY OF THE INVENTION

In one form, the present invention satisfies the above-stated needs and overcomes the above-stated and other deficiencies of the related art by providing a gas ionizer with at least one cleanable ionizing wire electrode for converting a non-ionized gas stream into an ionized gas stream. The ionization and cleaning can be run continuously and simultaneously. The ionizer may have a housing with an inlet, an outlet, and a channel therebetween through which at least one of the ionized gas stream and the non-ionized gas stream may flow. The ionizing wire electrode may be at least partially disposed within and stationary relative to the channel and may produce charge carriers in response to the provision of an ionizing signal to thereby convert the non-ionized gas stream into the ionized gas stream. Naturally, the ionizing wire will have a surface that develops a layer of contaminant byproducts over time as a natural consequence of its use as an ionizing electrode.

The ionizer may also include a frame that is at least partially disposed within the channel such that at least one of the ionized gas stream and the non-ionized gas stream flow therethrough. The frame may have plural support/cleaning elements for supporting the at least one ionizing wire in a configuration that is at least generally perpendicular to the non-ionized gas stream. Further, the frame may be mounted such that the support elements clean the insulating layer of contaminant byproducts off of the surface of the ionizing wire in response to rotation of at least one of the frame and the ionizing wire relative to one another. In various preferred embodiments, such rotation may either be continuous or periodic and either user-initiated or automated based on one or more desired factors (such as use-time, ion balance of the ionized gas stream, and/or some quality of the ionizing wire or other parameter(s).

In some embodiments, the support elements clean the layer of contaminant byproducts off of the surface of the ionizing wire during rotation of the frame and while the ionizing wire produces charge carriers in response to the provision of an ionizing signal. This may occur continuously or periodically. Further, the layer of byproducts may be insulating and the support elements may be electrically isolated from one another. If so, the insulating layer of contaminant byproducts may be cleaned off of the surface of the ionizing wire by micro-discharge between the electrically isolated support elements and the ionizing wire during rotation of the frame and during the provision of an ionizing signal to the ionizing wire.

Methods of cleaning accordance with the invention may be performed on a gas ionization apparatus of the type having a frame for resiliently supporting at least one ionizing wire that produces charge carriers and an insulating layer of contaminant byproducts in response to the provision of an ionizing signal thereto. Such methods may comprise providing an ionizing signal to the ionizing wire to thereby produce charge carriers and rotating the frame relative to the ionizing wire to thereby clean the insulating layer of contaminant byproducts off of the ionizing wire. In preferred method, the step of rotating may comprise continuously rotating the frame relative to the ionizing wire by more than 180 degrees to thereby clean contaminant byproducts off of the ionizing wire. In other preferred methods, the step of providing an ionizing signal to the ionizing wire continuously produces an accumulating layer of insulating contaminant byproducts on the ionizing wire, the step of rotating further comprising continuously rotating the frame relative to the ionizing wire, and the step of rotating continuously cleans off the layer of insulating contaminant byproducts by micro-discharge between the frame and the ionizing wire during rotation of the frame and during the provision of an ionizing signal to the ionizing wire.

Naturally, the above-described methods of the invention are particularly well adapted for use with the above-described apparatus of the invention. Similarly, the apparatus of the invention are well suited to perform the inventive methods described above.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings wherein like numerals represent like steps and/or structures and wherein.

DETAILED DESCRIPTION OF THE PREFERRED EMBODIMENTS

Figure 1B:
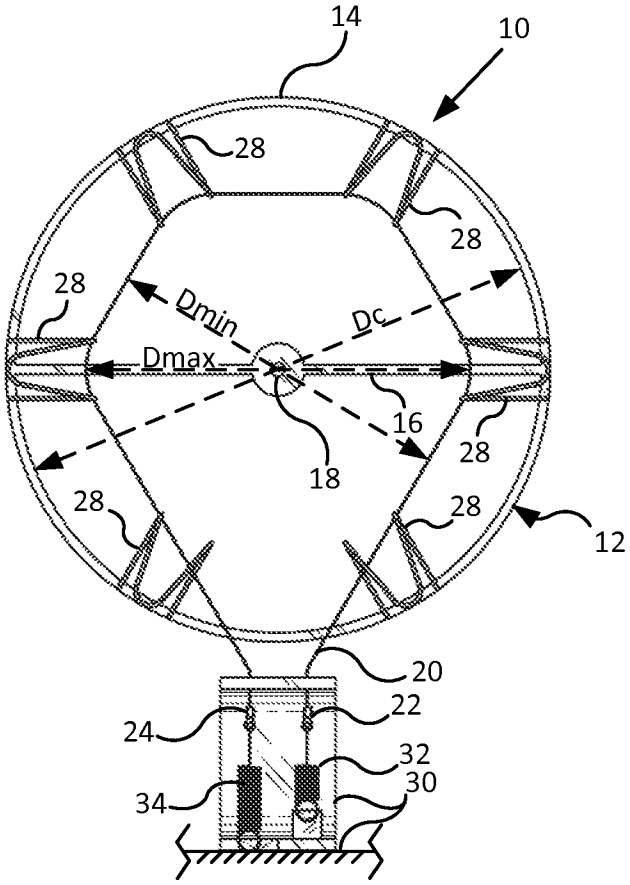
FIGS. 1A through 1C are, respectively, partial side-elevation, front, and perspective views of a gas ionization apparatus in accordance with a first preferred embodiment of the invention.
Figure 1A:
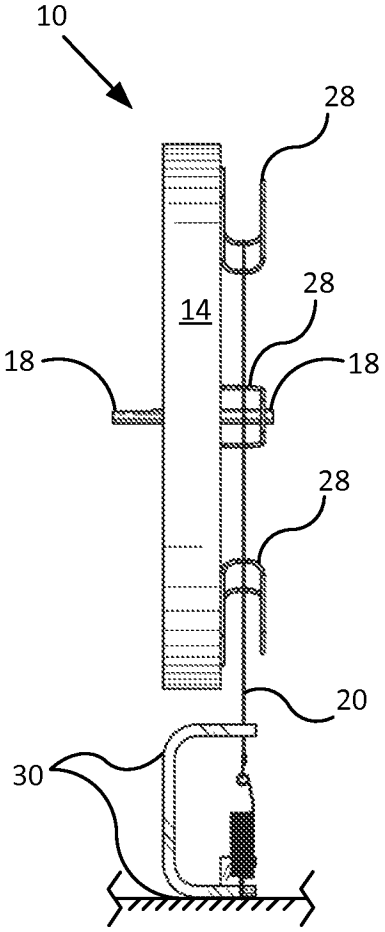
Figure 1C:
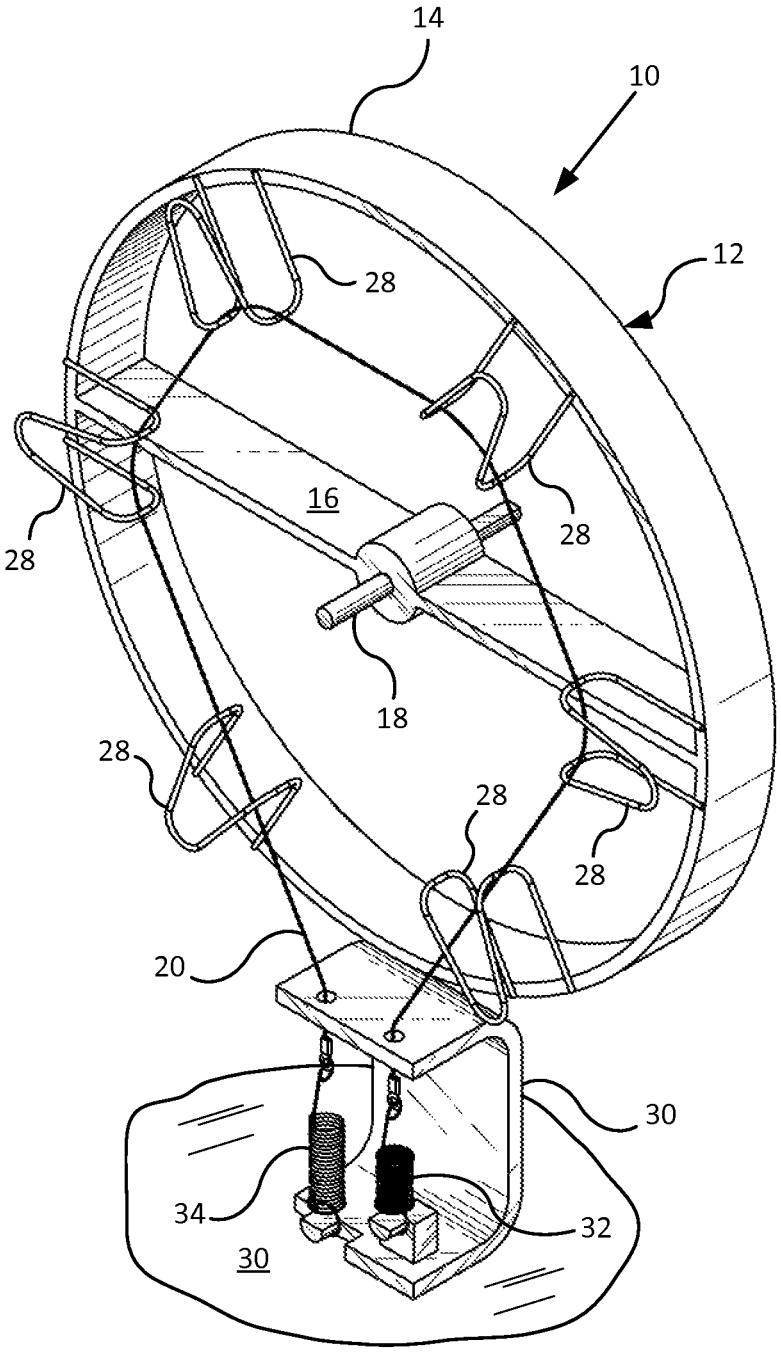

With joint reference to FIGS. 1A through 1C, a first preferred gas ionization blower 10 is shown in partial side-elevation, front, and perspective views. As shown, ionizer 10 may include at least one cleanable ionizing wire electrode 20 for converting a non-ionized gas stream into an ionized gas stream as it flows in a downstream direction. The ionizer may have a housing 30 (shown in part as a broken surface and including a U-shaped bracket) with an inlet, an outlet, and a channel therebetween (not shown) through which at least one of the ionized gas stream and the non-ionized gas stream may flow. Housing 30 may be of the type shown and described in the incorporated patents and/or of the type shown and described below with respect to FIGS. 4B and 5. Ionizing wire 20 may be at least partially disposed within the channel and may produced charge carriers in response to the provision of an ionizing signal to thereby convert the non-ionized gas stream into the ionized gas stream. As is generally the case, the ionizing wire will have a surface that develops contaminant byproducts (corrosion) over time as a natural consequence of its use as a high voltage corona ionizer.

Ionizer 10 may also include a frame 12 that may take any one of a wide variety of physical configurations and is preferably integrally molded of an isolative/insulative material such as ABS plastic, ceramic, Bakelite, etc. It preferably includes a generally circular outer ring 14, one or more rigid spokes (or, alternatively, flat blades) 16, and a central axle 18 that defines an axis of rotation that is at least generally perpendicular a plane containing the wire ionizer and aligned with the downstream direction of gas flow. When frame 12 is disposed within a housing channel in accordance with the invention, axle 18 is preferably at least generally coaxial with the channel. Frame 12 is preferably at least partially disposed within the housing channel such that at least one of the ionized gas stream and the non-ionized gas stream flows through the open space defined by the frame. As with other embodiments shown and described herein, frame 12 is preferably axially aligned with a motorized blower fan (not shown in this Figure) which preferably has an outer diameter that is at least generally equal to that of ring 14. It will be appreciated that this blower fan may be positioned either upstream or downstream of frame 12 as desired by an ordinary artisan.

In the most preferred ring/blade form shown in the FIGS. 2A-2C and 4A-4B, frame 12' and frame 12''' comprise an ionized air/gas flow collimator for more efficient delivery of ionized gas streams to the targeted neutralization object/area. This is because the plural blades 16' of the collimator frame reduce the spiraling turbulence inherent in the air flow emanating from the rotating fan blades (for example, fan blades 62). Reducing the turbulence, in turn, reduces ion recombination loses as the ionized stream travels from the ionizing blower to the target. It has been empirically determined that a frame with six to eight collimator blades 16' provides sufficient collimization in inventive ionizers. It has also been determined that effective collimization can be achieved with a collimator that is either upstream or downstream of the ionizing wire electrode.

Frame 12 may have plural support elements 28 for supporting ionizing wire 20 in a looped configuration that is at least generally perpendicular to axle 18 and to the non-ionized gas stream. This means for supporting 28 preferably takes that form of plural (preferably four to eight) bent/curved wire hooks/guides (for example, U-shaped or V-shaped) that are symmetrically and fixedly attached around ring 14. When resiliently tensioned against elements 28, ionizing corona wire 20 is preferably configured as a relatively large diameter open loop emitter of about 3 inches to about 6 inches and tensioned. Ionizing corona wire 20 may be made from any one or more of a wide variety of known materials such as 100 micron polished Tungsten wire, 100 micron Titanium wire, or 100 micron stainless steel wire. However, the diameter of these wires may be in the range of about 20 microns to about 150 microns, and they are preferably between about 60 microns and about 100 microns. Further, any wire materials of similar strength, flexibility, and oxidation resistance may also be used.

As shown, corona filament 20 may terminate at first and second ends 22 and 24 and may be tensioned (within a range of about 10 grams and about 100 grams) by one or more springs 32 and 34 interposed between ends 22 and 24 and housing 30. Further, at least one adjustable tensioning element may (optionally) be used between housing 30 and at least one of the wire ends such that the tension of the ionizing wire can be adjusted to a desired amount (for example, anywhere between about 40 grams and about 60 grams). Ends 22 and 24 may include loops, apertured termination elements, or any other functionally equivalent structures that permit the ends to quickly engage/disengage from springs 32 and/or 34, which, in turn, engage a desired portion of the apparatus housing. Whether or not adjustable, this configuration affords simple and quick replacement of wire 20 when it finally reaches the end of its useful life.

The supporting guides/elements 28 may be at least substantially rigid and made from any one or more of a wide variety of known materials such as stainless steel (other oxidation resistant metals and metal alloys), conductive ceramics, dielectrics, conductive plastics, and/or semiconductors. The preferred materials are preferably softer than the ionizing filament material used so that frictional forces between the two elements do not prematurely wear the relatively delicate ionizing filament too quickly. If the supporting guides 28 are made from conductive or semi conductive materials, the ionization system can avoid concentrated barrier discharges that might otherwise occur at the point of contact between wire 20 and support elements 28. Two noteworthy improvements provided by the preferred embodiments discussed herein (over the known prior art) are that (1) contaminants generated by barrier discharge are minimized with the invention due minimal points of wire contact and preferably minimal use of insulative materials contacting the wire, and (2) contaminant byproducts that cleaned off of the ionizing wire by friction between supports 28 and wire 20 are released at one location (near the two ends of the wire) and this permits their capture and remote disposal (such as with a localize vacuum and/or filter arrangement).

When using semi-conductive and, especially, conductive support elements, electrostatic cleaning of the ionizing wire is achieved due to micro-discharge and this is independent of and in addition to the physical cleaning also described herein. In such a case, the supports are preferably electrically isolated/insulated from one another and from the remainder of the frame. This occurs because an insulating layer of contaminant byproducts is continuously accumulating during the production of charge carriers by the ionizing wire. As this build up occurs the conductive supports are no longer in electrical communication/contact with the ionizing wire. Instead, they form a capacitor with the wire where in contaminant layer is the dielectric. When conditions (such as an increase in voltage on the ionizing wire) become correct, dielectric breakdown causes a micro-discharge between the support and the wire and this destroys the insulating contaminant layer at the point of discharge. With a high voltage and frequency AC ionizing voltage and with a slow rotational speed of the frame (e.g., 1 rpm), this effect may occur many thousands of time a second. The effect is further enhanced by the use of multiple supports, each of which may have multiple points of contact (in the arrangement of FIGS. 1A through 1C there are six supports with 10 points of contact). The effect can be augmented even further if the supports include wire bristles since each of the contacting bristles may provide micro-discharge. The net effect is to continuously (although this effect may be considered discrete, it occurs so often during a single revolution of the frame that it is—for practical purposes—continuous and is, thus, described herein as continuous) clean the layer of contaminant byproducts off of the surface of the ionizing wire by micro-discharge. This particularly advantageous because various contaminant layers (e.g., tungsten oxide) cannot be effectively cleaned with physical means alone. This is because contaminant layers are relatively durable compared to the ionizing wire itself and attempting to scrape off such insulating layers by physically bearing against them (relying on frictional forces) would radically shorten the life of the ionizing wire due to abrasion of the wire itself. Thus, the most preferred embodiments of the invention keep the ionizing wire in near ideal condition due to a constant combination of relatively gentle physical contact means and non-physical/electrical means of micro-discharge.

As an optional feature, at least one of plural support/cleaning elements 28 may comprises an adjustable and resilient tensioning element such that the tension of the ionizing wire can be adjusted to a desired level. In particular, this means for adjustably tensioning corona wire 20 may include a coil spring mounted between at least one end of the ionizing wire and a threaded screw that is mounted to the housing so that the spring may be biased by rotation the screw. This also permits relatively fast and simple removal and replacement of the ionizing wire.

Since ionizing wire emitter 20 is suspended on supporting elements 28, its loop-size and position depend on the location and configuration of supporting elements 28. Therefore, elements 28 are preferably configured such that the average wire loop diameter of wire 20 is $De=(Dmax+Dmin)/2$ so wire 20 is positioned at the point of maximum air velocity from the blower fan. This provides optimal ionizing cell efficiency and fastest ion delivery to the charged object. If diameter of ring 14 is equal Dc and it is close to diameter of the blower fan, this condition can be expressed as the ratio of the average wire loop diameter to the ring diameter ($De/Dc$). The various parameters noted above are preferably selected such that this ratio is between about 0.5 and about 0.9. Most preferably, this ratio should be between about 0.6 and about 0.8.

Further, frame 12 is preferably mounted to the housing such that support elements 28 clean accumulated contaminant byproducts (corrosion) off of the surface of ionizing wire 20 in response to movement of at least one of frame 12 and ionizing wire 20 relative to one another. As shown in FIG. 1A through FIG. 1C, ionizing wire 20 may remain stationary relative to housing 30 and frame 12 may rotate relative to wire 20. However, it is within the skill of ordinary artisans to modify this preferred embodiment such that frame 12 remains stationary and ionizing wire 20 is movable.

In the various preferred embodiments discussed herein, such rotation may either be user-initiated, or automated based on one or more desired factors (such as use-time, ion balance of the ionized gas stream, and/or some quality of the ionizing wire). Further, if desired, rotational cleaning may occur continuously (to nearly avoid contaminant accumulation altogether), periodically, upon start-up, and/or at specific any time desired. In clean room environment automatic cleaning is preferably performed on a periodic schedule when the blower fan is turned "Off" or is running at low speed to prevent dispersing of products of cleaning (buildup contaminants) from the ionization cell to the target of charge neutralization. Rotation of frame 12 may be either unidirectional or bidirectional and any desired amount of rotation may be used, including any amount less than 360 degrees, 360 degrees, or more than 360 degrees. Rotation in either direction of at least 180 degrees is far more rotation than has been suggested or taught in the prior art. Indeed, the prior art is believed to only teach wire rotation to a small degree when no ionizing signal is applied thereto. Thus, no rotation of a frame relative to a stationary area wire is taught at all. Nor does the prior teach rotation of any element(s) while an ionizing signal is applied to a wire electrode. Rotation of frame 12 can be performed manually or automatically by a small servo motor (not shown). To ease manual rotation of the frame, at least one side of the frame may, optionally, include a knob, a handle, recess, or functionally equivalent structure (none of which is shown herein) for a user to grasp during rotation. As noted herein, the most preferred frame rotation is uni-directional, slow and continuous as long as an ionizing signal is provided to a stationary ionizing wire being cleaned.

Since supporting hooks/guides 28 function as both supporting and cleaning elements, guides 28 gently polish/scrape accumulated contaminant byproducts/corrosion off of the surface of resiliently tensioned ionizing wire 20 during rotation of frame 12. Those of ordinary skill in the art will appreciate that this means for supporting/cleaning may can be combined with one or more cleaning brushes (not shown) incorporated into supporting elements 28. It will be appreciated that the intensity of cleaning operation (or cleaning force) can be adjusted by varying wire tension applied to ionizing wire 20. When support elements 28 slowly moving in one direction they transport/move accumulated byproduct contaminants until they fall from ionizing wire 20. This effect can be used to collect and remove contaminants from the flow path of the gas stream, for example, in a clean room environment.

Figure 2B:
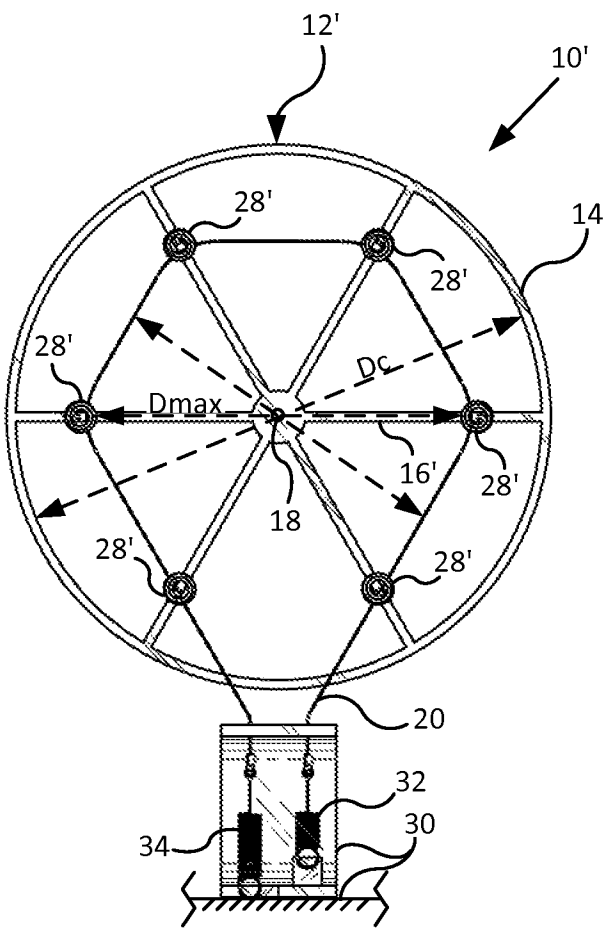
FIGS. 2A through 2C are, respectively, partial side-elevation, front, and perspective views of a gas ionization apparatus in accordance with a second preferred embodiment of the invention.
Figure 2A:
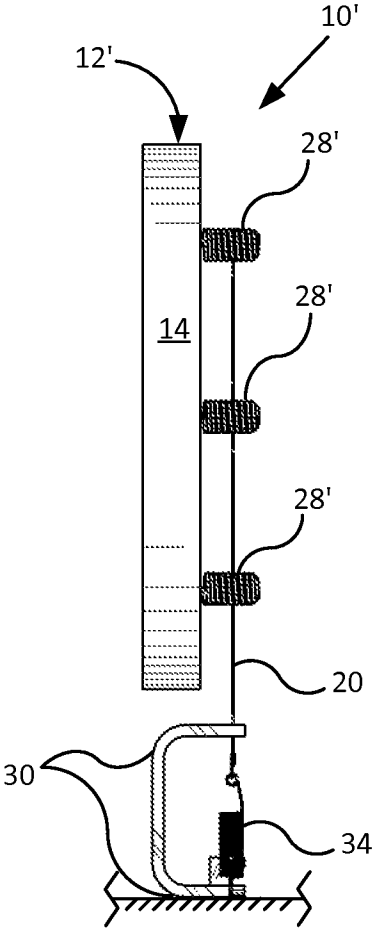
Figure 2C:
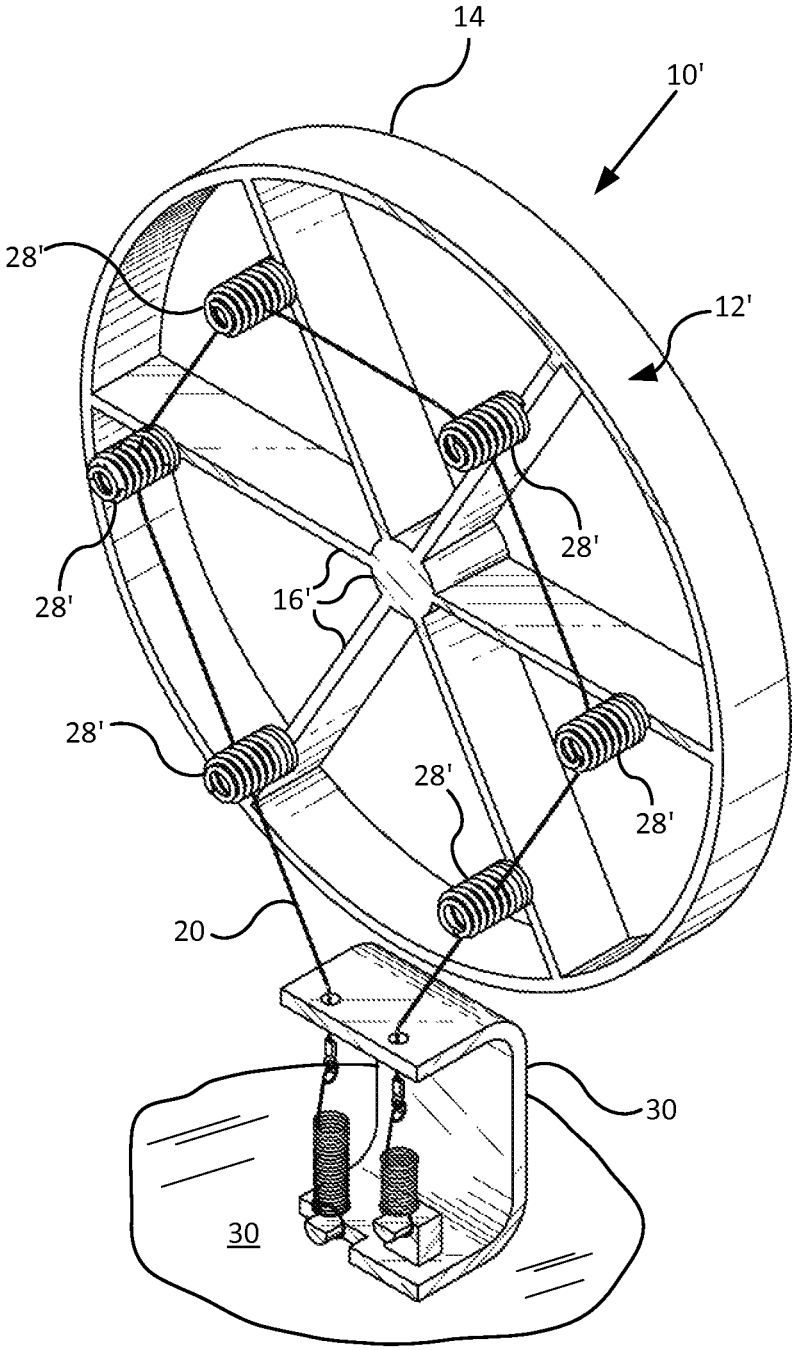

Turning now to FIGS. 2A through 2C there is shown a second preferred embodiment of the present invention which includes a gas ionization apparatus 10'. The gas ionization apparatus 10' shown in FIGS. 2A through 2C is substantially identical in structure and function to apparatus 10 described above with respect to FIGS. 1A through 1C and the description thereof will not be repeated except to the extent that it differs from apparatus 10.

As shown in FIGS. 2A through 2C, frame 12 may include plural spoke/flat blades 16' radially arranged within ring 14. Also, each of supporting elements 28' may comprise a multi-coil spring 28', wherein ionizing wire 20 may be supported between adjacent coils of the spring to provide maximum contact area with wire emitter 20 during cleaning. With such spring type means for supporting, the wire tension should be sufficient to allow the ionizing wire to wedge itself between a pair of adjacent coils of the spring and move toward to inner side of the spring. In this way both sides of the wire will be cleaned because of two-fold surface contact with multi-coil springs 28'. Those of ordinary skill in the art will appreciate that this means for supporting/cleaning may can be combined with one or more cleaning brushes (not shown) incorporated into supporting elements 28'. Although supporting elements 28' may be symmetrically and fixedly attached around ring 14, they are preferably fixedly attached to spokes/blades 16' to place wire 20 in an optimum location relative to the gas stream(s) passing therethrough.

Figure 3B:
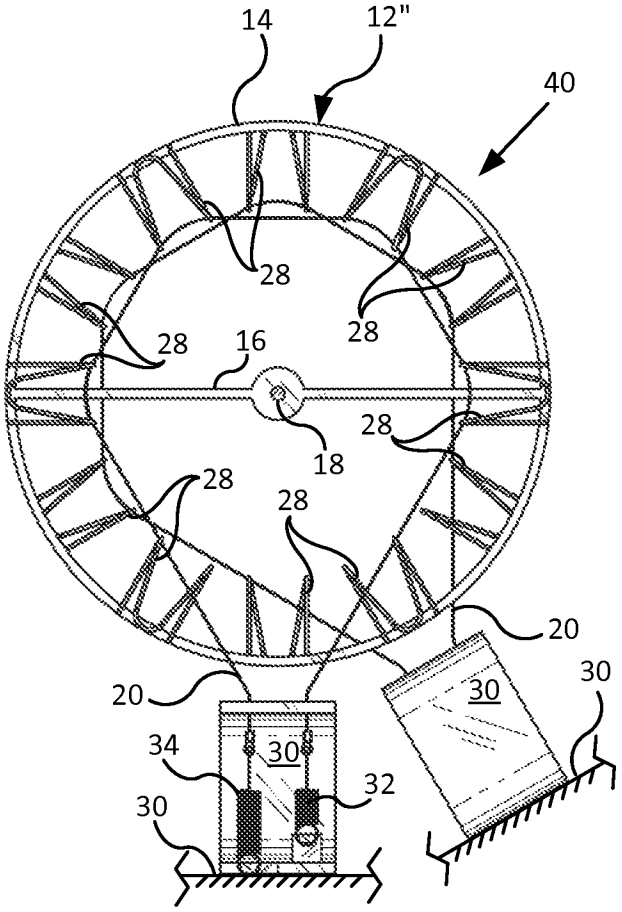
FIGS. 3A through 3C are, respectively, partial side-elevation, front, and perspective views of a gas ionization apparatus in accordance with a third preferred embodiment of the invention.
Figure 3A:
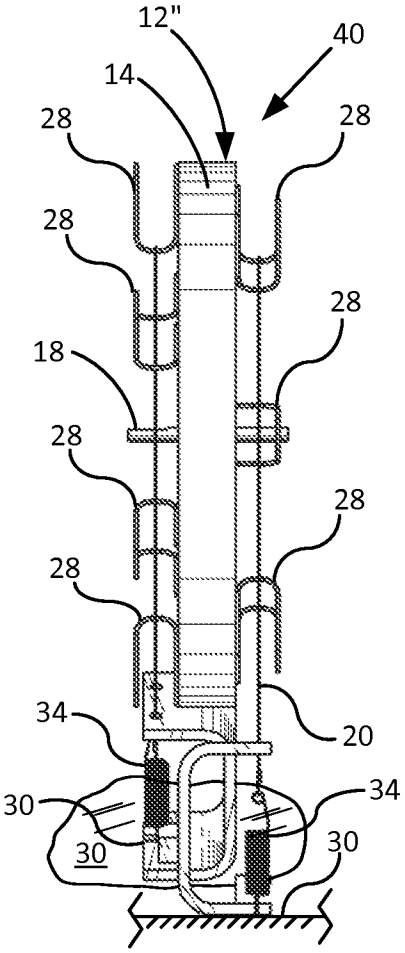
Figure 3C:
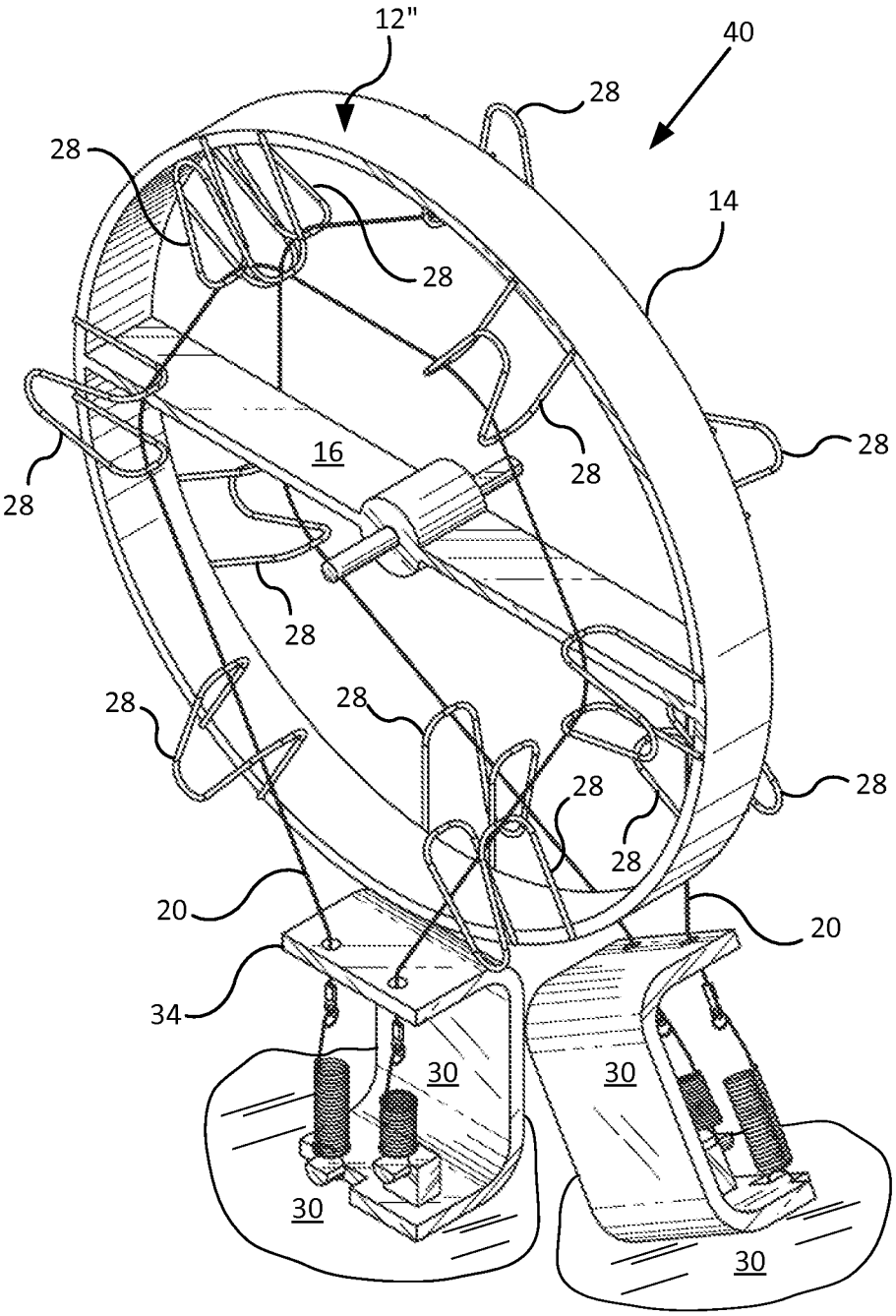

Turning primary focus now to FIGS. 3A through 3C, there is shown a third preferred embodiment of the present invention which includes a gas ionization apparatus 40. Apparatus 40 shown in FIGS. 3A through 3C is substantially identical in structure and function to apparatus 10 and 10' described above with respect to FIGS. 1A through 2C and the description thereof will not be repeated except to the extent that it differs from apparatus 10 and 10'.

As shown in FIGS. 3A through 3C, gas ionization apparatus in accordance with a third embodiment may include double the ionization capacity of a single blower type ionizer by supporting ionizing wires on both of inlet and outlet sides of a single frame. In particular, this embodiment is nearly identical to the embodiment of FIGS. 1A through 1C Ionizing wires except that angularly offset second means for supporting 28 is fixedly attached to frame 12 opposite the first means for supporting 28 of the first embodiment (the angular offset reducing electrical field interaction between the various supporting elements). Thus, one set of supporting elements 28 resiliently tensions a first wire 20 on an inlet side of frame 12 facing the housing inlet (not shown here) and another set of supporting elements 28 resiliently tensions a second wire 20 on an outlet side of frame 12 facing the housing outlet (not shown herein). In this way, the ionization capacity of the ionizer is greatly increased and support elements 28 will simultaneously clean contaminant byproducts off of both of ionizing wires 20 with a single rotational movement of frame 12. While both of wires 20 are preferably powered by a single ionizing power supply, those of ordinary skill will appreciate that separate power supplies may be used instead. Further, in light of the disclosure herein it is within ordinary skill to combine different wire supporting arrangements in this embodiment. For example, using the frame spokes 14' will permit the use of multi-coil springs 28' of FIGS. 2*a* through 2C on one side of frame 12' while also permitting the use of hooks 28 of FIGS. 1A through 1C on the opposite side frame 12'. If desired, this may configure first and second ionizing wires 20 into loops of different sizes to thereby present a different ion density pattern during ionization of the gas stream flowing therethrough.

Figure 4A:
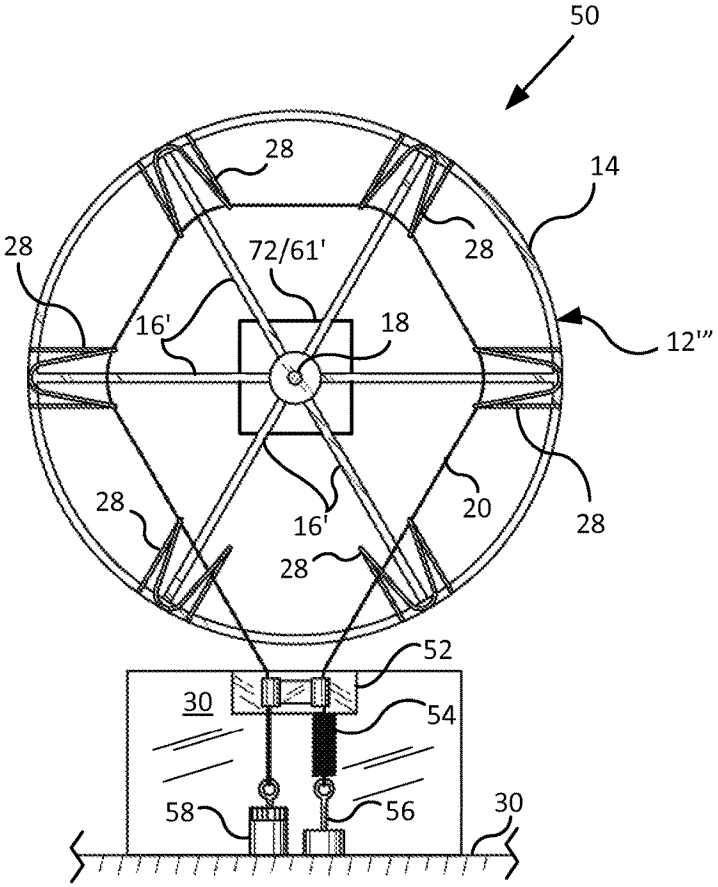
FIGS. 4A and 4B are, respectively, partial front and side-elevation views of a gas ionization apparatus in accordance with a fourth preferred embodiment of the invention.
Figure 4B:
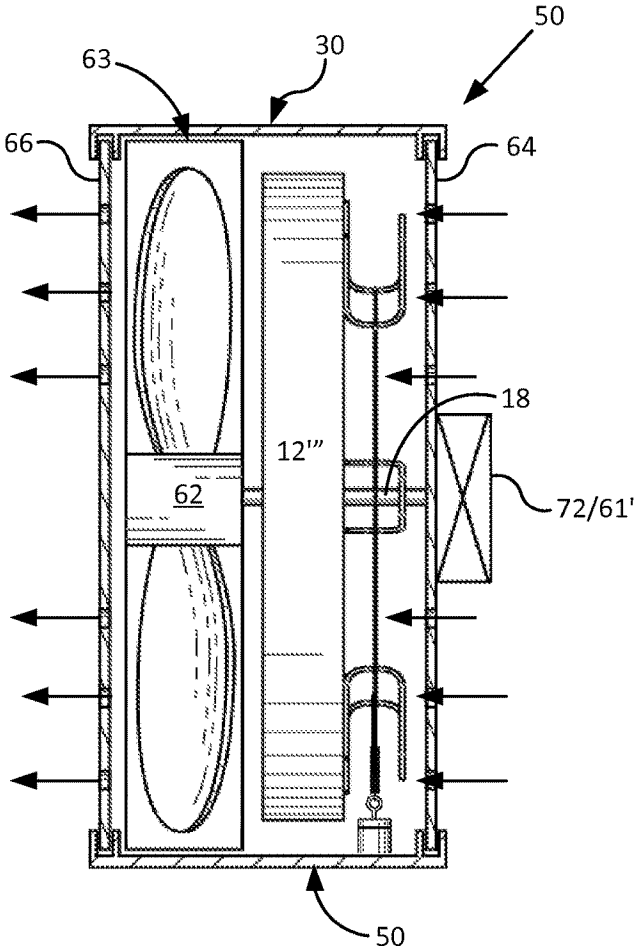

Turning primary focus now to FIGS. 4A and 4B, there is shown a fourth preferred embodiment of the present invention which includes a gas ionization apparatus 50. Since apparatus 50 is substantially identical in structure and function to apparatus 10, 10', and 40 described above with respect to FIGS. 1A through 3C, the description thereof will not be repeated except to the extent that it differs from apparatus 10, 10' and 40.

FIG. 4A shows a preferred apparatus 50 variant of the present invention in which one coil spring 54 resiliently affixes and tensions one end of ionizing wire 20 to housing connector 56. Further, the other end of ionizing wire 20 is attached to an adjustable tensioning element 58 with a strain gauge (or other convention equivalent tension sensor) incorporated therein. The strain gauge that may be part of element 58 may be used to monitor the condition of several aspects of the system. For example, a total lack of tension detected by the strain gauge may indicate that wire 20 has broken. Similarly, a decrease in detected tension may indicate that wire 20 has stretched or that support elements 28 may have become bent. Detected dynamic and static tensions may also suggest frictional conditions on the surface of ionizing wire 20 such as the accumulation of byproduct contaminants, and/or erosion of wire 20.

Those of skill in the art will recognize that wire 20 may be advantageously electrically coupled to an ionizing signal source (such as a conventional high voltage power supply—HVPS) through elements 54, 56, and 58. Wire guide 52 helps constrain movement of wire 20 for a more reliable alignment/interface with elements 54, 56, and 58.

A more complete image of the embodiment of FIG. 4A is shown in FIG. 4B. As shown there, housing 30 of apparatus 50 preferably includes a gas stream inlet side (to the right) and a gas stream outlet side (to the left). Apertured grill 64 is positioned on the blower inlet side, close to and parallel with ionizing wire 20. Apertured grill 64 serves as a finger guard and as a reference electrode for ionizing wire 20. Apertured grill 66 is positioned downstream at the housing outlet. It serves as a protective screen and as an ionized gas stream ion balance sensor. As shown, automatic rotation of frame 12''' is preferably achieved with a small, low-power/low-speed service micro-motor (5 volt DC) 61 in physical communication with the shaft 18. Motor 18 is preferably aligned with the center of inlet guard grill 64. A motorized blower 63 is disposed downstream of frame 12''' and includes a fan 62 that is generally equal to the diameter of ring 14 of frame 12'''.

Figure 5:
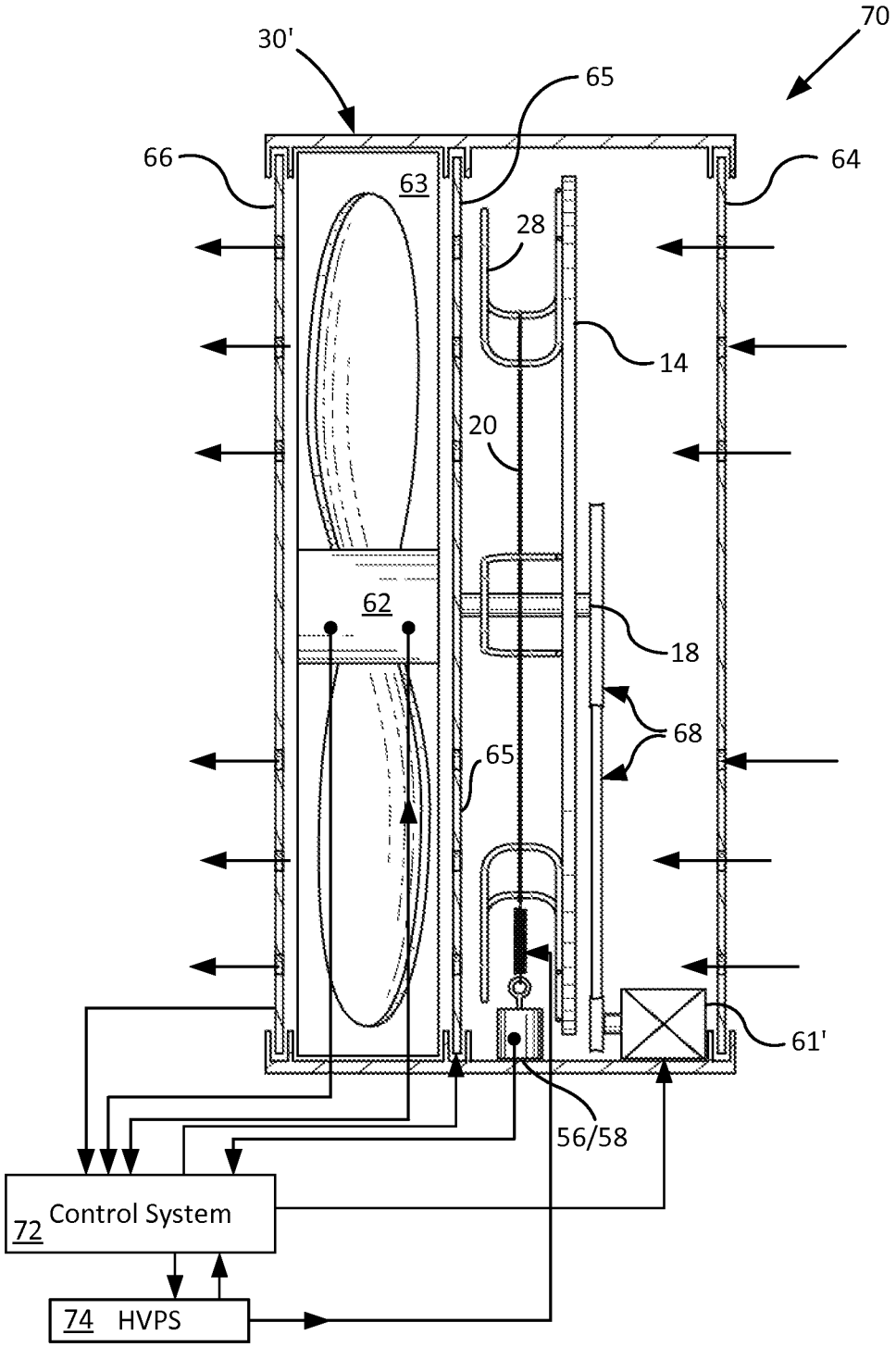
FIG. 5 is a partially schematic side-elevation view of a gas ionization apparatus in accordance with a fifth preferred embodiment of the invention.

Turning now to FIG. 5, there is shown a fifth preferred embodiment of the present invention which includes a gas ionization apparatus 70. Since apparatus 70 is substantially identical in structure and function to apparatus 10, 10', 40, and 50 described above with respect to FIGS. 1A through 4B, the description thereof will not be repeated except to the extent that it differs from apparatus 10, 10', 40, and 50.

As shown in FIG. 5, gas ionization apparatus 70 differs from earlier discussed embodiments in (1) the addition of another sensor/reference grill 65, (2) the use of a substantially planar ring 14, (3) the use of a variant mechanical connection between motor 61' and axle 18, and (4) the inclusion of greater control system 72 and HVPS 74 details. HVPS 74 may be a conventional micro-pulse power supply for delivering high voltage pulses of very short duration because such power supplies are known to result in minimal accumulated emitter buildup and ozone/nitrogen oxide generation. For example, the micro pulse power supply may be the same or similar to that used with Ionizing TargetBlower Model 6202e made and sold by Simco-Ion of 1750 North Loop Road, Alameda, Calif. 94502.

Preliminary tests of the invention (at 12" distance to CPM and high fan speed) show that it provides discharge times in the range 0.9-1.5 seconds which is considered reasonable for "isostat" balance mode in the range (+/−) 3-5 Volts. Further, ion balance in the range+/−25 Volts (in some cases+/−10 Volts) can be achieved if the ionization system operates in self-balancing ("isostat") mode. In this mode both ionizing wire 20 and reference electrode/grill 65 are capacitively coupled to HVPS 74. For more precise ion balance adjustment (for example, between about 1 Volt and about 3 Volts), an active ion balanced closed loop control system can be used. In such a closed-loop control system, an ionizing signal source 74, at least one sensor 66 for monitoring the ionized gas stream, and a control system 72 are communicatively coupled together such that control system 72 may vary the ionizing signal provided to ionizing wire 20, at least in part, responsive to the monitored ionized gas stream.

In use, all of the above-disclosed embodiments operate in essentially the same preferred way. At start, control system 72 may check the status of ionizing wire 20 for static and/or dynamic. tension by sampling the tension via strain gauge 58. Static tension/friction indicates the condition of wire 20, and spring (s) 54. If the wire tension is normal, control system 72 may turn on motor 61' to rotate frame 12/12'/12''/12''' and continue to measure dynamic tension/friction of ionizing wire 20. This wire status monitoring process may start or continue the cleaning process of wire 20.

If both tensions are within an acceptable range, the system may turn on and monitor fan 62. Once fan 62 reaches a prescribed speed, the system may turn on HVPS 74. Then, the system may check the ion current between ionizing wire 20 and reference electrode/grill 65. At the same time, control system 72 may start monitoring an ion balance signal generated by sensor 66. Control system 17 will then adjust HVPS 74 in closed loop mode to provide required positive and negative ion current (or discharge time) and a preset ion balance voltage. If the ion balance of the ionized gas stream is outside is a predetermined range, the frame may be automatically rotated relative to the ionizing wire 20 to thereby clean contaminant byproducts off of the ionizing wire.

In their most general form, methods of the using the apparatus embodiments of the invention entail (1) providing an ionizing signal to the ionizing wire to thereby produce charge carriers; and (2) rotating the frame relative to the ionizing wire to thereby clean the insulating layer of contaminant byproducts off of the ionizing wire. The step of rotating comprises continuously rotating the frame relative to the ionizing wire by more than 360 degrees to thereby clean contaminant byproducts off of the ionizing wire.

In more particular methods of use, the step of providing an ionizing signal to the ionizing wire continuously produces an accumulating layer of insulating contaminant byproducts on the ionizing wire, the step of rotating further comprising continuously rotating the frame relative to the ionizing wire, and the step of rotating continuously cleans off the layer of insulating contaminant byproducts by micro-discharge between the frame and the ionizing wire during rotation of the frame and during the provision of an ionizing signal to the ionizing wire.

Figure 6:
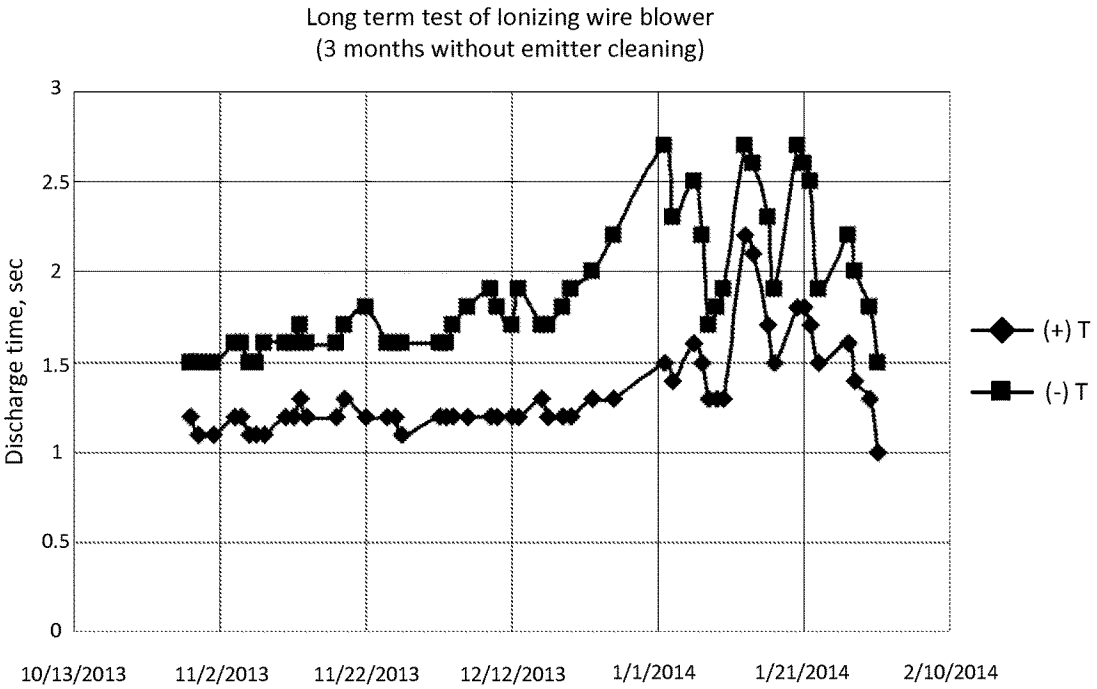
FIG. 6 is a chart illustrating discharge-time variations occurring during an extended period of use of a conventional gas ionizer.
Figure 7:
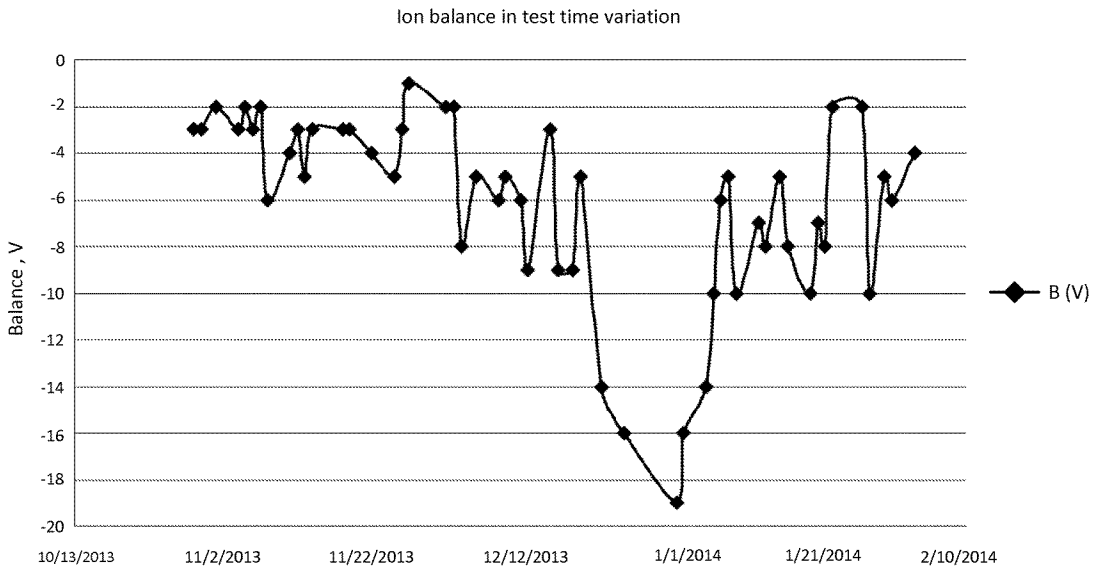
FIG. 7 is a chart illustrating ionized gas stream balance variations occurring during an extended period of use of a conventional gas ionizer.
Figure 8:
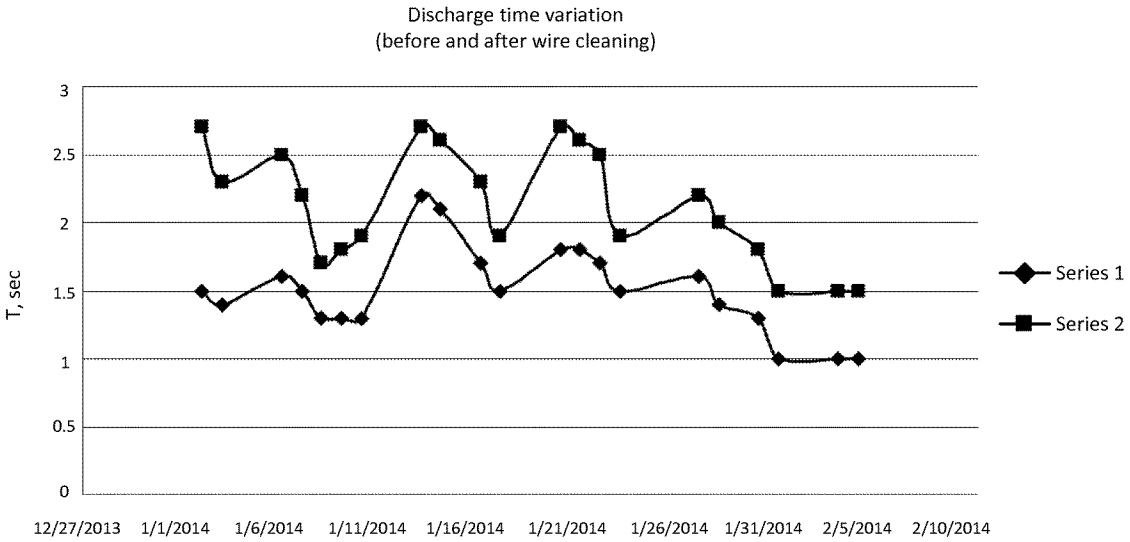
FIG. 8 is a chart illustrating discharge-time variations occurring during an extended period of use both with and without use of the present invention.

Performance test results for an ionizing blower substantially similar to that disclosed in FIGS. 4A and B is shown in FIGS. 6, 7, and 8. The test apparatus included a charge plate monitor (model 156A made by company "Trek Inc." of 190 Walnut Street, Lockport, N.Y. 14094) that was positioned at a distance of 6 inches away from the inventive ionizing blower being tested. FIG. 6 is a chart illustrating discharge-time variations occurring during an extended period of use of the ionizing wire blower without cleaning. As shown therein, the performance of the ionizing blower degrades over the course of several months as evidenced by the fact that it takes a progressively longer time (about 2.5 times longer) to discharge a controlled positive and negative test charge on the charge plate monitor. As discussed above, this is at least in large part due to a progress decrease ion production resulting from the accumulation of insulating layer of debris and/or contaminants on the ionizing wire that is in use for an extended period of time without cleaning.

FIG. 7 is a chart illustrating ionized gas stream balance variations occurring during the same period use of the same ionizing blower as discussed with respect to FIG. 6 (again without employing the cleaning methods of the invention). As shown therein, the contamination accumulating on the ionizing wire significantly increases balance variation and offset (up to −19 Volts).

FIG. 8 is a chart illustrating discharge-time variations occurring during a shorter period of use of the inventive apparatus both with and without using the cleaning operation of present invention. The cleaning operation was done by slow continuous rotation of the frame 14 (about 1 rpm) during the entire test period and the cleaning and ionization were run simultaneously. As clearly shown in FIG. 8, both positive and negative polarity discharge times are notably improved compared with the results shown in FIG. 6 when the ionizing wire is cleaned using the invention. In particular, if we compare date on FIGS. 6 and 8 we will see that cleaning operation returned discharge time to original data points. This indicates that the inventive ionizer cleaning methods and structures are consistently effective at restoring ionization efficiency to levels close to or equal to the ideal condition of a new ionization wire. This data suggests that maximal efficiency can be achieved by continuous and slow rotation of the frame supporting in the ionizing wire relative to the wire and/or the housing (assuming the application environment permits such operation).

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

Other than in the operating examples or where otherwise indicated, all numbers or expressions referring to quantities of ingredients, reaction conditions, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

What is claimed is:

1. A gas ionization apparatus for use with a power supply that provides an ionizing signal, the apparatus converting a non-ionized gas stream flowing in a downstream direction into an ionized gas stream and comprising:

a housing with an inlet, an outlet, and a channel therebetween through which at least one of the ionized gas stream and the non-ionized gas stream flows;

at least one ionizing wire electrode at least partially disposed within and stationary relative to the channel, the ionizing wire producing charge carriers in response to the provision of an ionizing signal thereto to thereby convert the non-ionized gas stream into the ionized gas stream, the ionizing wire having a surface that develops a contaminant byproducts in response to the provision of the ionizing signal; and a frame at least partially disposed within the channel for rotation such that at least one of the ionized gas stream and the non-ionized gas stream flows therethrough, the frame having plural support elements for supporting the at least one ionizing wire in a configuration that is at least generally perpendicular to the non-ionized gas stream, the frame being rotatably mounted such that the support elements clean the contaminant byproducts off of the surface of the ionizing wire during rotation of each of the support elements of the frame by at least 180 degrees in a single direction.

2. The gas ionization apparatus of claim 1 wherein the channel defines a central axis, wherein the frame is rotatably mounted for rotation about the channel and wherein the frame continuously rotates more than 360 degrees about channel axis while the ionizing wire produces charge carriers in response to the provision of an ionizing signal thereto.

3. The gas ionization apparatus of claim 2 wherein the frame continuously rotates about the channel axis while the ionizing wire produces charge carriers in response to the provision of an ionizing signal thereto, and wherein the frame comprises an ionized gas flow collimator with plural blades.

4. The gas ionization apparatus of claim 1 wherein the frame comprises an inlet side facing the housing inlet and an outlet side facing the housing outlet, wherein the at least one ionizing wire is supported on the inlet side of the frame and stationary relative to the channel, and wherein the apparatus further comprises at least one other ionizing wire electrode supported by plural support elements on the outlet side of the frame and stationary relative to the channel such that the support elements simultaneously clean contaminant byproducts off of both of the ionizing wires when the frame is rotated.

5. The gas ionization apparatus of claim 1 wherein the ionizing wire comprises a loop that is resiliently tensioned against more than one of the plural support elements and the support elements clean contaminant byproducts off of the surface of the ionizing wire while the ionizing wire produces charge carriers in response to the provision of an ionizing signal thereto by physically bearing against the layer of contaminant byproducts during rotation of the frame.

6. The gas ionization apparatus of claim 5 wherein each of the plural support elements comprises a curved hook that is at least substantially rigid, and wherein the tension of the ionizing wire is between about 30 grams and about 100 grams.

7. The gas ionization apparatus of claim 5 wherein the apparatus further comprises at least one resilient tensioning element, wherein the ionizing wire further comprises first and second ends, and wherein the first and second ends are removably mounted to the housing via the at least one resilient tensioning element such that the ionizing wire is replaceable by another ionizing wire.

8. The gas ionization apparatus of claim 5 wherein the apparatus further comprises an adjustable tensioning element to resiliently tension the ionizing wire such that the tension of the ionizing wire can be adjusted to be at least between about 50 grams and about 100 grams.

9. The gas ionization apparatus of claim 1 wherein the at least one support elements are electrically isolated from one another, wherein the layer of contaminant byproducts is an insulating layer that continuously accumulates during the production of charge carriers by the ionizing wire, and wherein the insulating layer of contaminant byproducts is continuously cleaned off of the surface of the ionizing wire by micro-discharge between the electrically isolated support elements and the ionizing wire during rotation of the frame and during the provision of an ionizing signal to the ionizing wire.

10. A gas ionization apparatus for use with a power supply that provides an ionizing signal, the apparatus converting a non-ionized gas stream flowing in a downstream direction into an ionized gas stream and comprising:

a housing with an inlet, an outlet, and a channel therebetween through which at least one of the ionized gas stream and the non-ionized gas stream flows;

an ionizing wire electrode, at least partially disposed within and stationary relative to the channel, for producing charge carriers in response to the provision of an ionizing signal thereto to thereby convert the non-ionized gas stream into the ionized gas stream, the ionizing wire having a surface that develops a layer of contaminant byproducts in response to the provision of the ionizing signal thereto; and a frame disposed within the channel for rotation such that at least one of the ionized gas stream and the non-ionized gas stream may flow therethrough, the frame having plural support elements for resiliently supporting the ionizing wire such that the plural support elements cleans the contaminant byproducts off of the surface of the ionizing wire during rotation of each of the support elements of the frame by at least 180 degrees in a single direction.

11. The gas ionization apparatus of claim 10 wherein the channel defines a central axis, wherein the frame is rotatably mounted for rotation about the channel axis, and wherein the frame continuously rotates more than 360 degrees about channel axis while the ionizing wire produces charge carriers in response to the provision of an ionizing signal thereto.

12. The gas ionization apparatus of claim 11 wherein the frame continuously rotates about the channel axis while the ionizing wire produces charge carriers in response to the provision of an ionizing signal thereto, and wherein the frame comprises an ionized gas flow collimator with plural blades.

13. The gas ionization apparatus of claim 10 wherein the frame further comprises an inlet side facing the housing inlet and an outlet side facing the housing outlet, wherein the ionizing wire is supported on the inlet side of the frame and stationary relative to the channel, and wherein the apparatus further comprises at least one other ionizing wire electrode supported by the plural support elements on the outlet side of the frame and stationary relative to the channel such that the plural support elements simultaneously cleans contaminant byproducts off of the both of the ionizing wires when the frame is rotated.

14. The gas ionization apparatus of claim 10 wherein the ionizing wire comprises a loop that is resiliently tensioned against the plural support elements, and wherein the plural support elements cleans contaminant byproducts off of the surface of the ionizing wire while the ionizing wire produces charge carriers in response to the provision of an ionizing signal thereto by physically bearing against the layer of contaminant byproducts during rotation of the frame.

15. The gas ionization apparatus of claim 10 wherein the plural support elements comprises plural curved hooks that are at least substantially rigid, wherein at least one of the curved hooks is conductive and electrically isolated from at least one other curved hook, and wherein the insulating layer of contaminant byproducts is continuously cleaned off of the surface of the ionizing wire by micro-discharge between the at least one semiconductive and electrically isolated curved hook and the ionizing wire during rotation of the frame and production of charge carriers by the ionizing wire.

16. The gas ionization apparatus of claim 10 wherein the apparatus further comprises at least one resilient tensioning element, wherein the ionizing wire further comprises first and second ends, and wherein the first and second ends are removably mounted to the housing via the at least one resilient tensioning element such that the ionizing wire maybe removed and replaced by another ionizing wire.

17. The gas ionization apparatus of claim 10 wherein the apparatus further comprises a resilient tensioning element for adjustably tensioning the ionizing wire to be between about 50 grams and about 100 grams.

18. The gas ionization apparatus of claim 10 wherein at least one of the plural support elements is conductive and electrically isolated from at least one other support element, wherein the layer of contaminant byproducts is an insulating layer that continuously accumulates during the production of charge carriers by the ionizing wire, and wherein the insulating layer of contaminant byproducts is continuously cleaned off of the surface of the ionizing wire by micro-discharge between the at least one conductive and electrically isolated support element and the ionizing wire during rotation of the frame and during the production of charge carriers by the ionizing wire.

19. A method of cleaning a gas ionization apparatus of the type having a channel through which at least one of an ionized gas stream and a non-ionized gas stream may flow, the apparatus also having a rotatable frame at least partially disposed within the channel and at least one stationary ionizing wire, the method comprising:

passing the non-ionized gas stream through the channel;

resiliently supporting the at least one stationary ionizing wire at least partially within the frame, at least partially within and stationary relative to the channel, in a configuration that is at least generally perpendicular to the flow of the non-ionized gas stream;

providing an ionizing signal to the ionizing wire to thereby produce charge carriers, that convert the non-ionized gas stream into the ionized gas stream, and a layer of contaminant byproducts on the surface of the stationary ionizing wire; and rotating plural support elements of the frame by at least 180 degrees in a single direction relative to the stationary ionizing wire to thereby clean the layer of contaminant byproducts off of the surface of the stationary ionizing wire during rotation of the frame to thereby remove the contaminant byproducts from the flowing gas stream.

20. The method of claim 19 wherein the step of rotating comprises continuously rotating the frame relative to the ionizing wire by more than 360 degrees in a single direction to thereby clean the contaminant byproducts off of the surface of the ionizing wire.

21. The gas ionization apparatus of claim 1 wherein the frame rotates the support elements continuously in the single direction relative to the wire.

* * * * *